US012644295B2

(12) United States Patent
Jertberg

(10) Patent No.: US 12,644,295 B2
(45) Date of Patent: Jun. 2, 2026

(54) PROOFING FALL SAFETY SYSTEM

(71) Applicant: POPEYE'S LOGISTICS LTD., Sicamous (CA)

(72) Inventor: Lawrence Jertberg, Sicamous (CA)

( * ) Notice: Subject to any disclaimer, the term of this patent is extended or adjusted under 35 U.S.C. 154(b) by 472 days.

(21) Appl. No.: 18/165,299

(22) Filed: Feb. 6, 2023

(65) Prior Publication Data

US 2023/0295938 A1 Sep. 21, 2023

Related U.S. Application Data

(60) Provisional application No. 63/306,775, filed on Feb. 4, 2022.

(51) Int. Cl.
*E04G 21/32* (2006.01)

(52) U.S. Cl.
CPC ..... *E04G 21/3214* (2013.01); *E04G 21/328* (2013.01)

(58) Field of Classification Search
CPC ..... E04G 21/3214; E04G 21/328; E04G 21/3276; E04G 3/265
See application file for complete search history.

(56) References Cited

U.S. PATENT DOCUMENTS

| | | | | |
|---|---|---|---|---|
| 777,441 | A | 12/1904 | Small | |
| 2,814,533 | A * | 11/1957 | Van Horn | E04G 3/26 182/14 |
| 3,237,717 | A | 3/1966 | Jackson | |
| 3,662,436 | A | 5/1972 | Roza | |
| 4,756,129 | A | 7/1988 | Webb | |
| 4,833,846 | A | 5/1989 | McFeetors et al. | |
| 5,054,576 | A * | 10/1991 | Glynn | E04G 21/3276 248/237 |
| 5,878,534 | A | 3/1999 | Gleave | |
| 6,668,509 | B1 * | 12/2003 | Krebs | E04D 13/12 52/703 |
| 8,596,414 | B1 * | 12/2013 | Lown | E04G 3/28 182/45 |
| 9,308,403 | B2 * | 4/2016 | Strawder | E04D 13/00 |
| 9,744,387 | B1 * | 8/2017 | Hung | E04G 21/328 |
| 10,071,268 | B2 | 9/2018 | Gaines | |
| 11,939,781 | B2 * | 3/2024 | Fabbi | A62B 35/0068 |
| 2001/0025464 | A1 * | 10/2001 | Poldmaa | E04D 13/12 52/633 |
| 2008/0309033 | A1 | 12/2008 | Twardzik et al. | |
| 2013/0062145 | A1 | 3/2013 | Inoue et al. | |
| 2022/0120101 | A1 * | 4/2022 | Austin | E04G 21/3276 |

FOREIGN PATENT DOCUMENTS

| | | | |
|---|---|---|---|
| EP | 1818480 | A2 | 8/2007 |
| EP | 2447437 | B1 | 10/2010 |
| GB | 2281093 | A | 8/1994 |

* cited by examiner

*Primary Examiner* — Noah Chandler Hawk
(74) *Attorney, Agent, or Firm* — Richard D. Okimaw

(57) ABSTRACT

A system and method for supporting at least one article on a roof. The system uses a carriage contained by an elongate member above a ridge of a roof to be translatable therealong. The carriage has a central body extending along an axis having a top surface, a pair of legs extending away from the axis of from the central body and a passage extending through the central body parallel to the axis. In use, adjusting the angle of the pair of legs is adjusted to correspond to the slope of the roof and positioning the central body above a ridge with a tensile member passing through a bore therein.

18 Claims, 8 Drawing Sheets

PROOFING FALL SAFETY SYSTEM

BACKGROUND

1. Technical Field

This disclosure relates generally to safety equipment and in particular to an apparatus and system for preventing fall injuries from roofs.

2. Description of Related Art

In construction and other industries, personnel are frequently required to attend to tasks on a roof. In such circumstances, the predominant risk to such workers is through falls from the elevated heights of the roof. Various attempts have been made to prevent or reduce injuries from falling off roofs. Many of such attempts involve providing barriers or fences around the roof. It will be appreciate that such attempts are time consuming to install and expensive.

Other solutions have provided tethers or lanyards connecting the worker to an anchor. Such systems frequently require the anchor to be secured to the roof itself and disadvantageously frequently only provide a radius of movement around the anchor to the worker. It will be appreciated that such radius may not correspond to the required work region or may excessively overlap the edge of the roof. Such solutions will frequently therefore require more than one anchor point to provide adequate coverage for the roof.

Some attempts have been made to provide a moveable anchor point along the peak of the roof. However such prior designs require the installation of the anchor structure within the ridge of the roof which may be undesirable. Furthermore, such designs do not permit their application to an existing roof without modification of the roof itself, thereby limiting the application of such designs.

SUMMARY OF THE DISCLOSURE

According to a first embodiment, there is disclosed an apparatus for supporting at least one article on a roof comprising a central body extending along an axis having a top surface, a pair of legs extending away from the axis of from the central body and a passage extending through the central body parallel to the axis.

The passage may comprise a bore with the axis extending therethrough. The central body may comprise a tubular member. The pair of legs may be rotatable relative to the central body. The pair of legs may be fixable relative to each other at one of a plurality of angles. The pair of legs may be pivotable along pivot axes parallel to the axis of the apparatus.

The central body may include a pair of spaced apart end rings with leg openings therebetween each sized to receive one of the pair of legs therein. The pair of legs may be supported within the leg openings with a rod extending therethrough. The pair of legs may include a pin extending therefrom receivable within an arcuate slot in at least one of the end rings. The apparatus may further comprise at least one fastener secured to the pin adapted to clamp the end ring between the fastener and the leg.

The pair of legs may comprise a planar member having at least one wheel thereunder. The at least one wheel may rotate about an axis parallel to the planar member. The at least one wheel may comprise a pair of spaced apart wheels.

The apparatus may further comprise a tool carrying body locatable on a top surface of the central body. The tool carrying body may be securable to the pair of legs.

According to a first embodiment, there is disclosed a method for supporting at least one article on a roof comprising providing a central body having a pair of legs extending away from an axis of the central body, adjusting the angle of the pair of legs to correspond to the slope of the roof and positioning the central body above a ridge with a tensile member passing through a bore therein.

According to a first embodiment, there is disclosed a fall arrest system comprising a carriage comprising an apparatus for supporting at least one article on a roof comprising a central body extending along an axis having a top surface, a pair of legs extending away from the axis of from the central body and a passage extending through the central body parallel to the axis, a pair of spaced apart clamps secureable to opposed ends of a roof ridge, an elongate tensile member extending between the clamps and passing through a bore in the carriage and at least one safety lanyard extending from the elongate tensile member to a worker.

Other aspects and features of the present disclosure will become apparent to those ordinarily skilled in the art upon review of the following description of specific embodiments in conjunction with the accompanying figures.

BRIEF DESCRIPTION OF THE DRAWINGS

The accompanying drawings constitute part of the disclosure. Each drawing illustrates exemplary aspects wherein similar characters of reference denote corresponding parts in each view.

DETAILED DESCRIPTION

Figure 1:
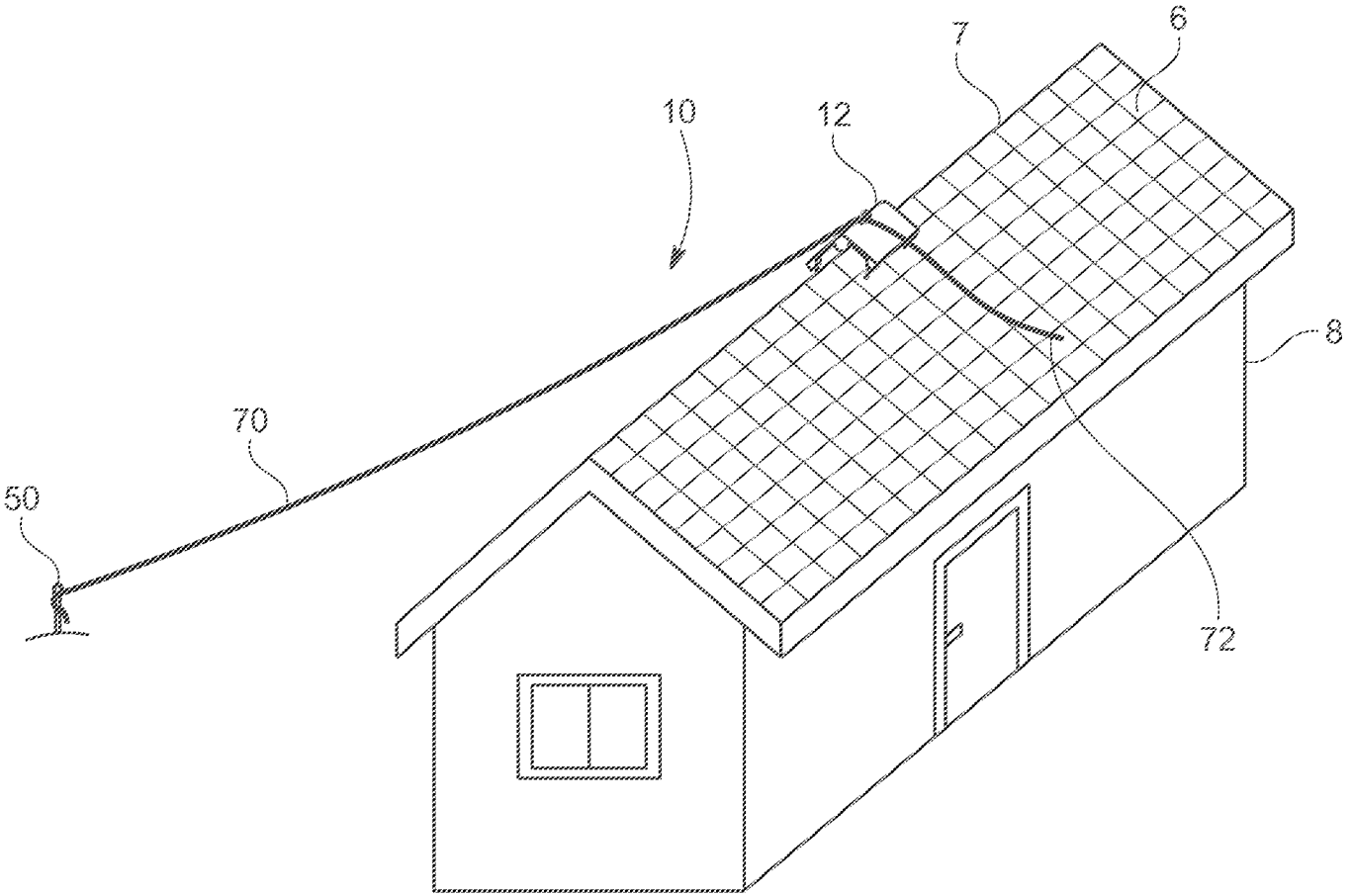
FIG. 1 is a perspective view of a house with a fall safety system according to an embodiment of the present disclosure applied thereon.

Aspects of the present disclosure are now described with reference to exemplary apparatuses, methods and systems. Referring to FIG. 1, an exemplary system for providing fall protection on the roof 6 of a house 80 according to a first embodiment is shown generally at 10. The system 10 comprises a roof ridge carriage 12, a ground anchor 50 and a rope 70 or other suitable tensile member. The carriage 12 is adapted to rest upon and over the ridge 7 of the roof and includes wheels or rollers 20 thereunder so as to permit movement along the ridge 7. In operation, the ground anchor 50 is secured in the ground or other suitable surface to one side of the roof as illustrated in FIG. 1. Thereafter a rope or other suitable tensile member is secured to the anchor 50 and passed over the carriage and secured to a user at an appropriate distance to prevent their fall or injury. In such a manner, the user may move along the roof while the carriage follows their movements along the ridge keeping them at the same distance from falling off the roof.

Figure 2:
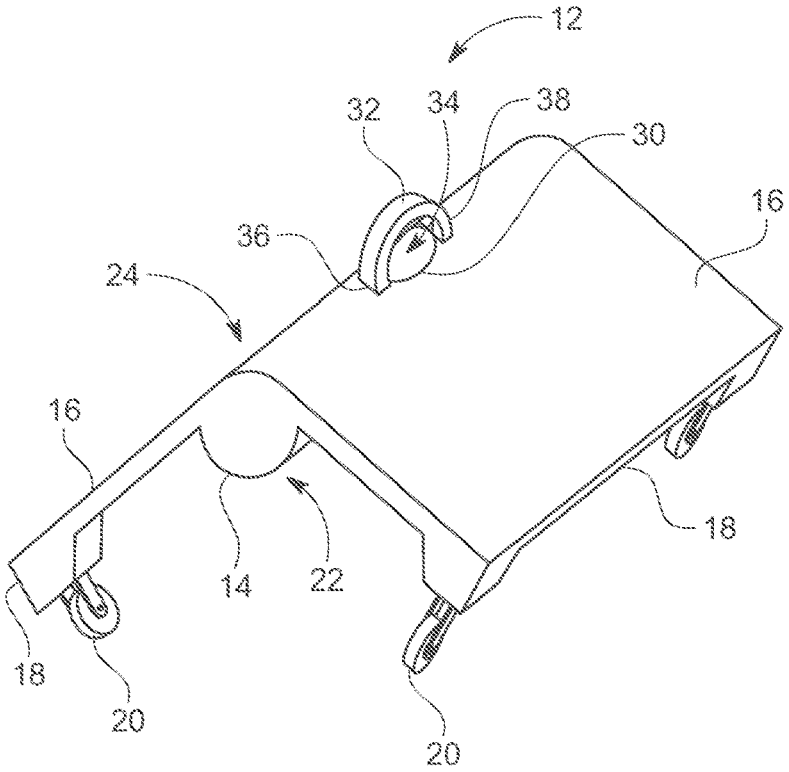
FIG. 2 is a perspective view of the carriage of the system of FIG. 1.

Turning now to FIG. 2, the carriage 12 includes a center body 14, and a pair of arms 16 extending to each side thereof. Although illustrated as substantially cylindrical, it will be appreciated that the center body 14 may be of any suitable shape. The arms 16 extend from the center body 14 to distal ends 18. The underside of each of the arms includes at least one, and preferably at least two rollers or wheels 20 proximate to the distal ends 18. The rollers 20 may extends substantially perpendicularly to the arms 16 as illustrated or may optionally be oriented to be perpendicular to the roof so as to maximize the contact therebetween so as to reduce point loads.

As illustrated, the center body 14 includes a top surface 24 and a bottom surface 22 oriented towards the roof. The top surface 24 includes a notch or recess 30 therein for receiving and supporting the rope 70 thereon. The top surface 24 may also optionally include a retainer 32 extending over the notch so as to form a bore 34 therewith. The bore 34 acts to retain the rope 70 on the notch and within the middle of the carriage 12 as the user moves around the roof. Although the bore 34 is illustrated as substantially circular herein, it will be appreciated that other shapes may also be utilized.

Figure 3:
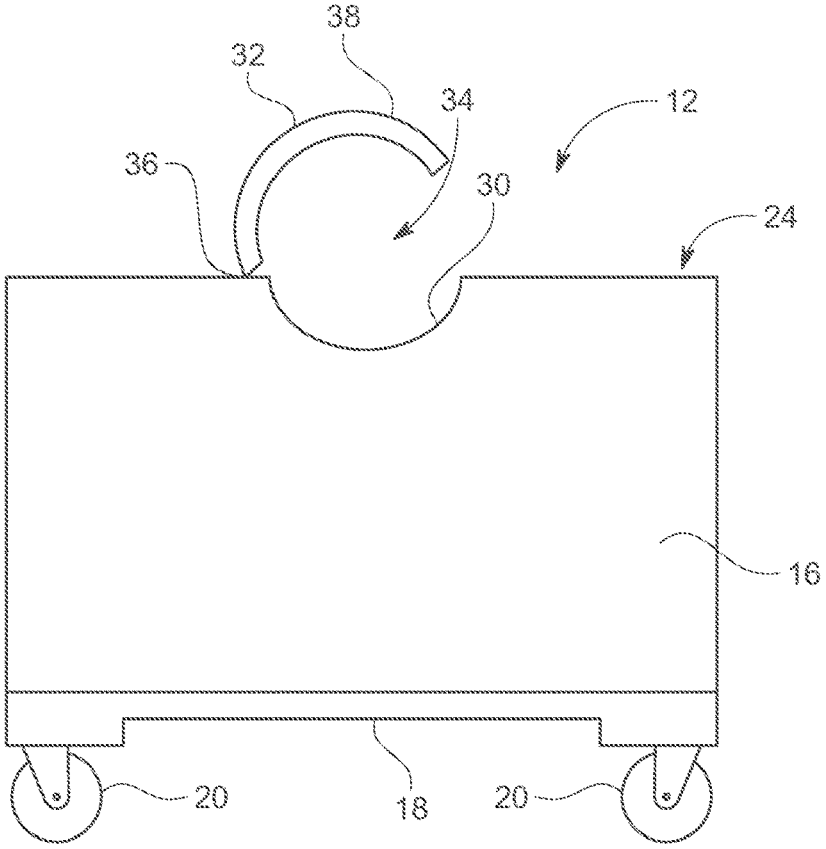
FIG. 3 is a side view of the carriage of FIG. 2 at an open position.

The retainer 32 extends between first and second ends, 36 and 38, respectively. As illustrated in FIG. 2, each of the first and second ends 36 and 38 may be connected to the top surface 24. Optionally, as illustrated in FIG. 3, the first side 36 may be handedly connected to the top surface and the second side 38 may be selectably securable with a clasp or latch (not illustrated) so as to allow the retainer 32 to be opened. It will be appreciated that such opening will facilitate the introduction of a rope into the bore 34. The latch may be selected to be of any suitable type, including but not limited to catches, pins or fasteners.

Figure 4:
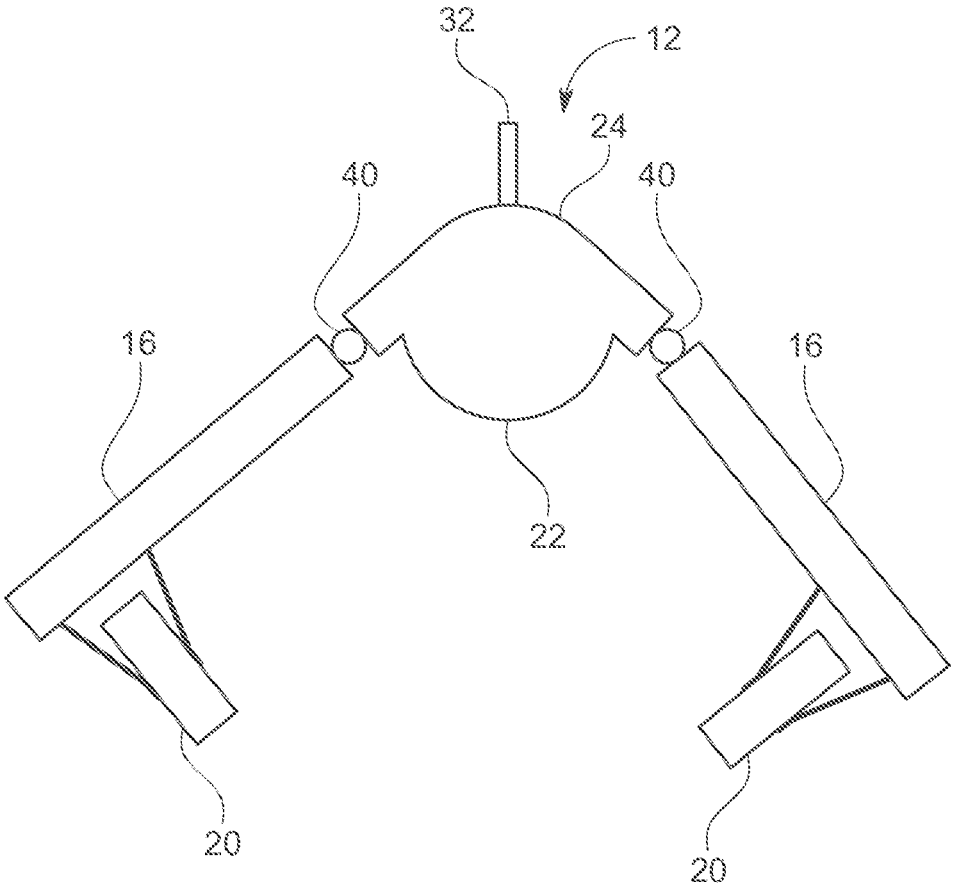
FIG. 4 is an end view of the carriage of FIG. 2 according to a further embodiment of the present disclosure.

As illustrated in FIG. 4, the arms 16 may optionally be angularly adjustably connected to the center body 14 so as to permit the relative angle therebetween to be adjusted. As illustrated in FIG. 4, the connection between the arms 16 and the center body 14 may be hinged, although it will be appreciated that other connection types may be utilized as well so as to allow the arms to be connected at one of a plurality of angles to the center body 14. In operation, it will be appreciated that such adjustment means will permit the carriage to be utilized on roofs having differing pitches while maintaining the desired alignment of the arms 16 and the roof surface. Such adjustable arms 16 may be fixable at one of a plurality of angles or may include continuous adjustment within a desired range.

Figure 5:
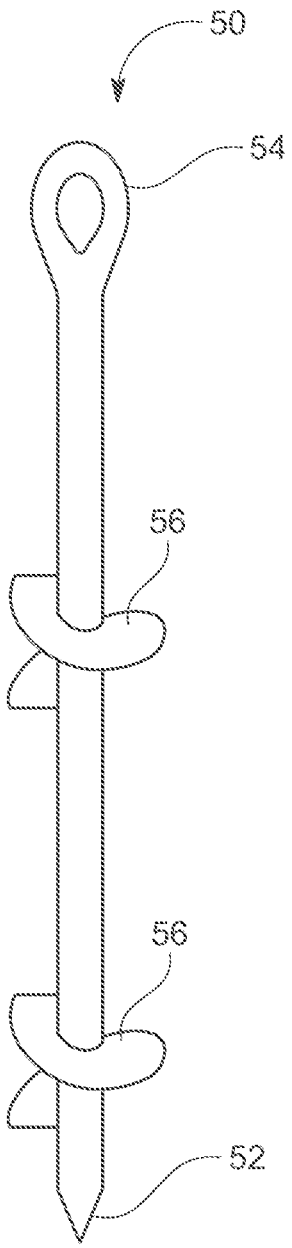
FIG. 5 is a perspective view of the ground anchor of the system of FIG. 1.

Turning now to FIG. 5, the anchor 50 comprises an elongate member having a sharpened point 52 at a bottom thereof and a rope securing means 54 at a top end thereof. As illustrated, the rope securing means 54 may include a loop to which a rope may be secured, although it will be appreciated that other means may also be utilized, including, by way of non-limiting example, carabineers, slots, fasteners or the like. The anchor 50 includes at least one screw auger 56 extending therearound. As illustrated in FIG. 5, the anchor may include two augers located at different locations along the shaft. The screw augers 56 serve to pull the anchor 50 into the ground as the shaft is rotated and resist pull out from the ground under a pulling force on the loop 54 by the rope. It will be appreciated that the size and location of the screw augers 56 will be selected to provide adequate pull out strength to resist the loads applied thereto by a rope under a fall condition of a user and will depend on the design application, user weight and soil type.

In operation, when a worker desires to work upon a roof, they may secure the anchor 50 in the ground on an opposite side from where they intend to work as illustrated in FIG. 1. Thereafter, the carriage 12 may be located on the roof ridge 7 such that the wheels 20 of each arm 16 are located on opposite sides of the roof ridge 7 with the bottom surface 22 of the center body 14 locate above the roof ridge. A user may then secure a rope 70 to the loop 54 and extend the rope 70 over the carriage within the notch 30. The retaining body 34 may optionally be opened to permit such location and thereafter closed and secured. A free end 72 or other portion of the rope 70 may then be secured with a lanyard or other connecting device to a harness worn by the worker or at any or other location on the worker by a distance selected to prevent injury from fall. Thereafter as the worker moves along the roof, the carriage will be moved along the ridge 7 of the roof 6 by the movement of the rope so as to permit free movement of the worker without preventing access to portions of the roof. When, the work is completed, the rope, anchor and carriage may then be removed leaving minimal damage to the roof.

Figure 6:
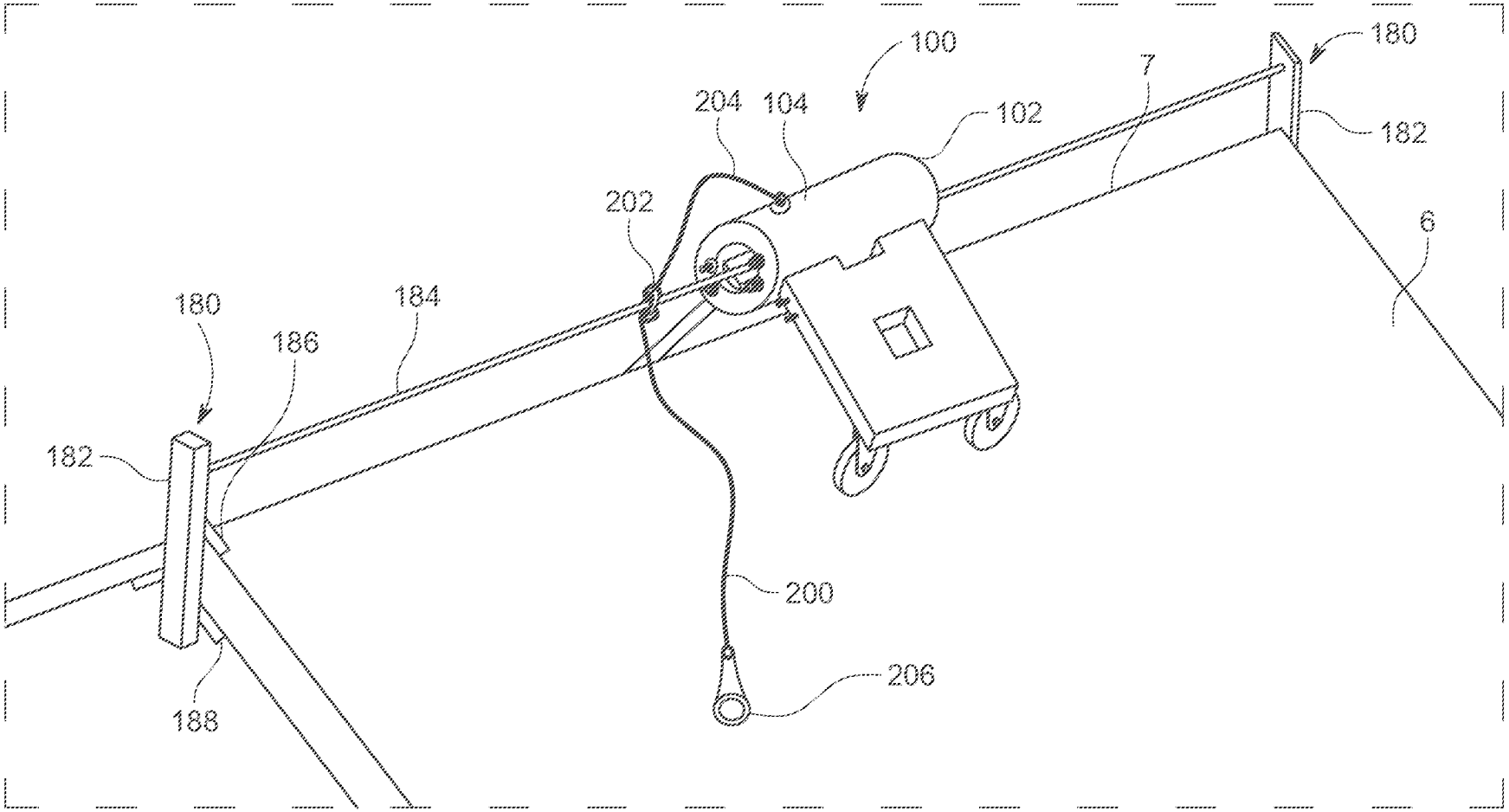
FIG. 6 is a perspective view of a fall safety system according to a further embodiment of the present disclosure.
Figure 7:
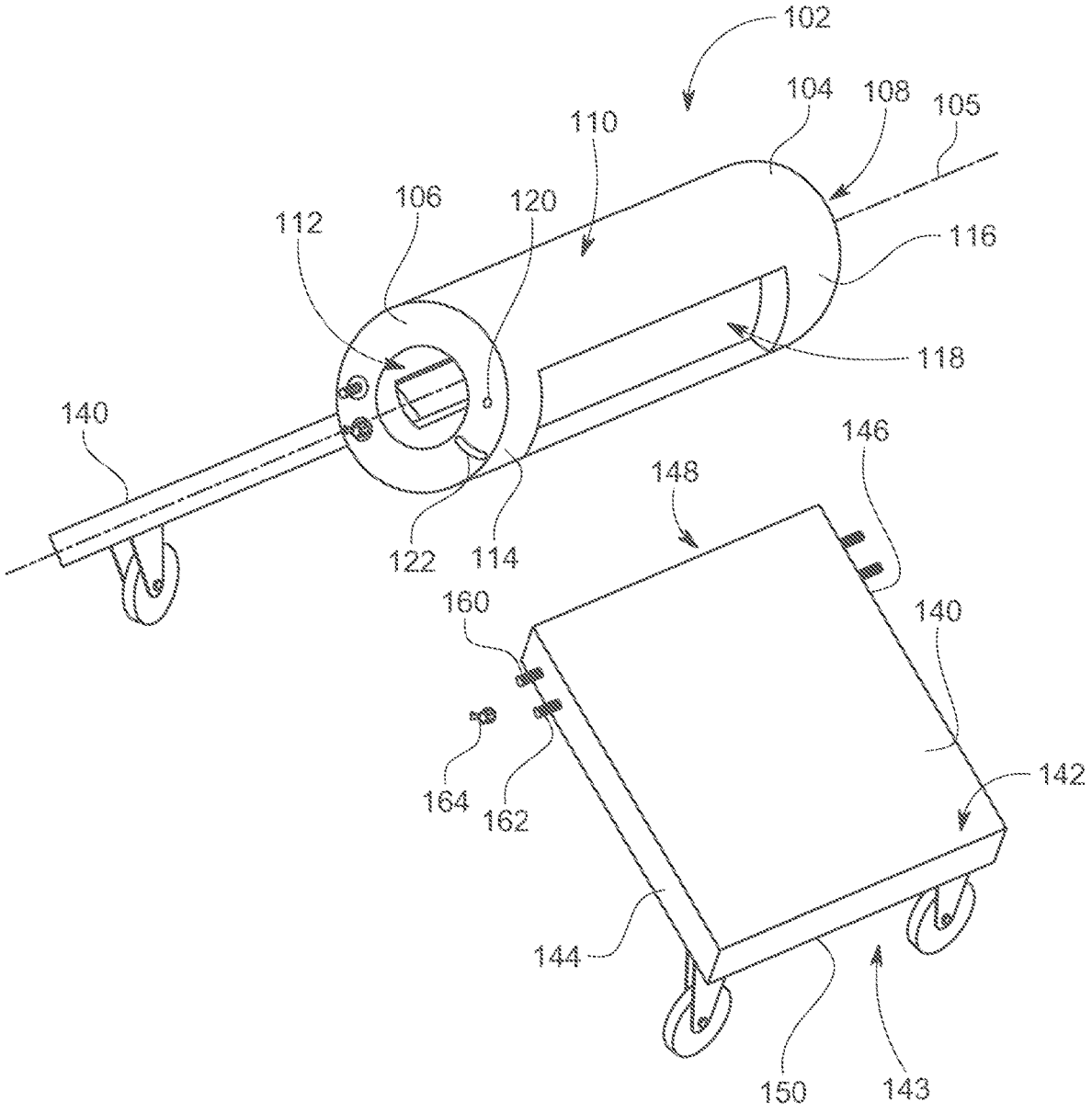
FIG. 7 is an exploded view of a carriage for use in the system of FIG. 6.

Turning now to FIG. 6, a further embodiment of the present disclosure is illustrated a system 100 in which a carriage 102 supported on a roof by a pair of legs 140. The carriage includes a passage 102 therethrough adapted to pass a tensile member above the ridge 7 of the roof 6. The carriage 102 may be adapted to support a plurality of tools or other objects thereon. As illustrated in FIG. 7, the carriage 102 comprises a central body 104 extending between first and second ends, 106 and 108, respectively along an axis 105. The central body 104 may be substantially tubular as illustrated or may be selected to be of any other cross-sectional shape. The central body 104 includes a top outer surface 110 and a central passage 112 therethrough. As illustrated, the axis 105 may pass through the central passage 112.

The central body 104 may be formed of first and second ends plate, 114 and 116, respectively proximate to the first and second ends 106 an 108 which circumferentially surround the central passage 112. Between the first and second end plates 114 and 116 the central body may include leg openings 118 sized to receive the legs 140 therein. In practice, the leg openings 118 may comprise a single opening on each side to receive the leg therein or may optionally comprise two or more openings spaced along the central body as illustrated in FIG. 5. In particular, the end plates may include pivot bores 120 and arcuate adjustment slots 122 therethrough. The arcuate adjustment slots 122 may have a radius about the pivot bores.

As illustrated in FIG. 7, the legs 140 are formed of a substantially planar member having top and bottom surfaces, 142 and 143, respectively, an extending between first and second side edges, 144 and 146, respectively and top and bottom edges, 148 and 150, respectively. The leg 140 may be sized to be received within the leg openings 118. Each leg includes at least one wheel 152 extending therefrom proximate to the bottom edge 150.

Each leg 140 may include a pivot pin 160 proximate to the top edge 148 sized and positioned to be passed through the pivot bores 120 in the central body 102. Alternatively, the leg may include a bore at a position corresponding to the pivot bores such that a common pin may be passed therethrough so as to pivotally support the leg within the leg opening. Each leg also includes an adjustment pin 162 proximate to the pivot pin 160 at a position adapted to pass through the adjustment slot 122 in the end plates 114 and 116. A fastener 164 may be provided which is securable to the adjustment pin 162 so as to enable the fastener and the leg to clamp the end plate therebetween at a desired angle.

Figure 8:
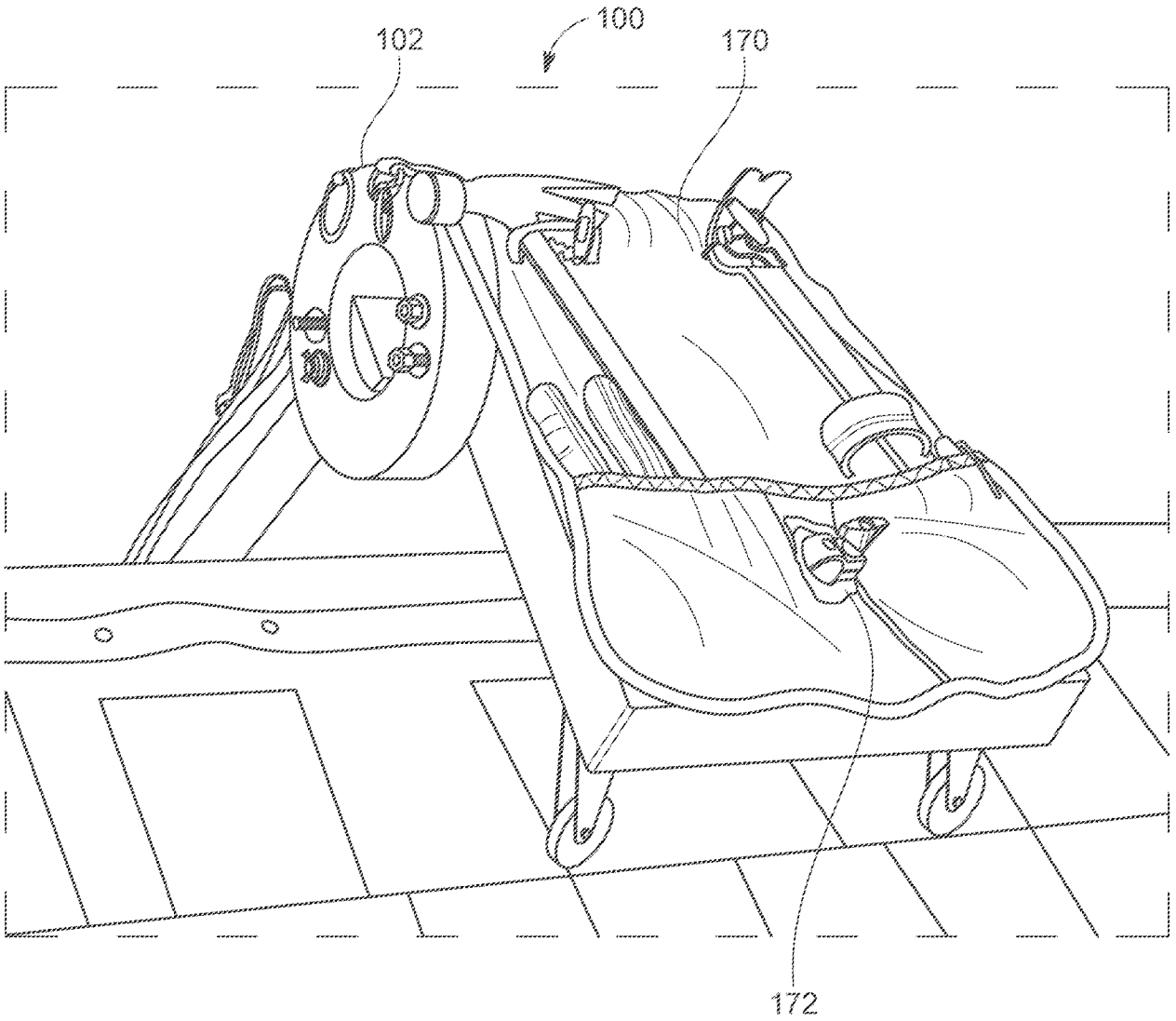
FIG. 8 is a perspective view of a carriage of FIG. 7 with an attached tool

With reference to FIG. 8, a tool carrier 170 may be provided for locating on the carriage 102. In particular the tool carrier 170 may comprise a body formed of any material, including rigid or flexible which is adapted to be located over the carriage 102. As illustrated in FIG. 8, the tool carrier may comprise a fabric body having one or more pockets adapted to hold tools or the like. The tool carrier 170 may also include a fastener, such as by way of non-limiting example, a clasp, latch or the like for securing the tool carrier to the carriage.

Figure 9:
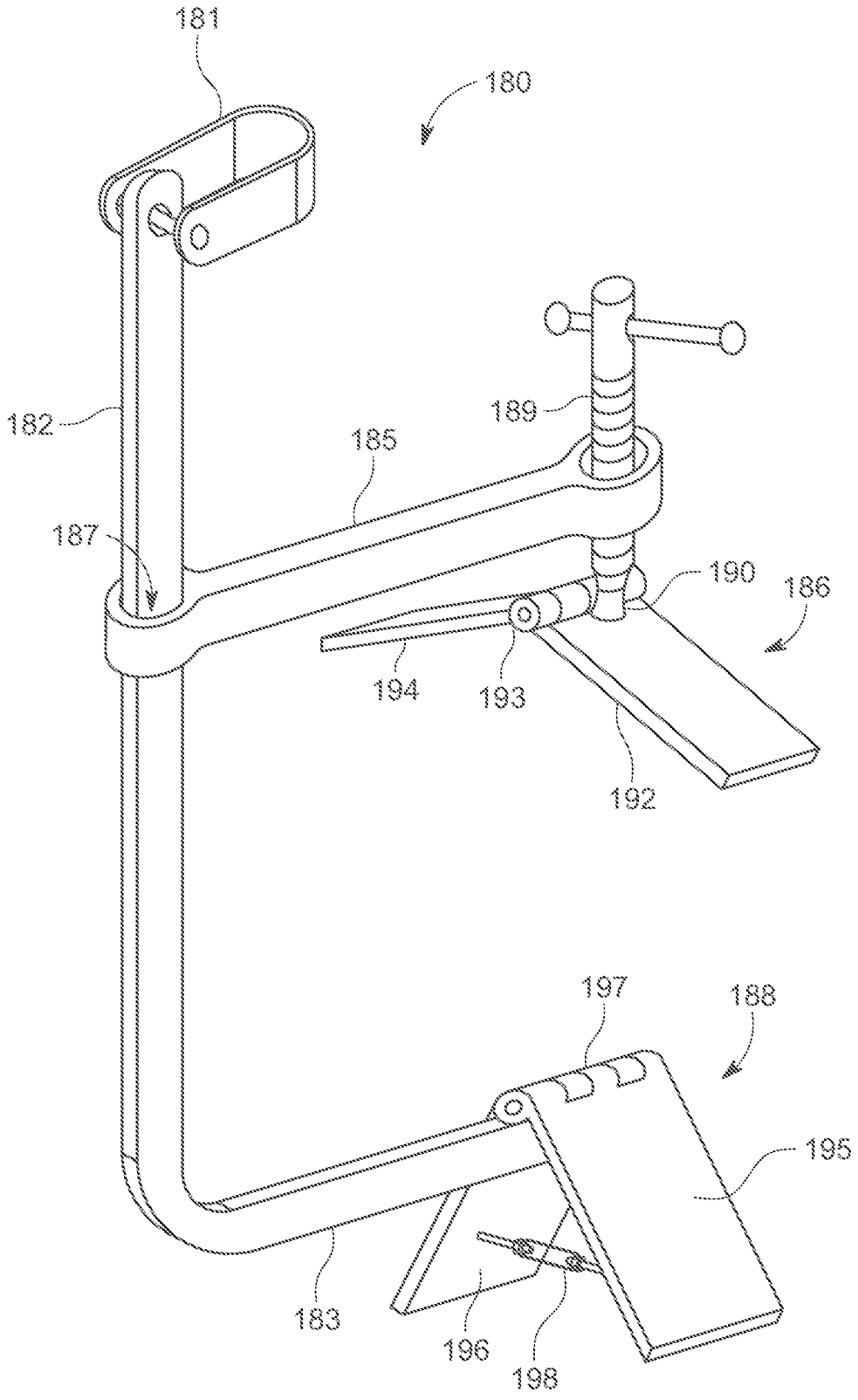
FIG. 9 is a perspective view of roof clamps for use in the fall arrest system of FIG. 6.

With reference to FIG. 6, the fall protection system 100 further includes a pair of roof clamps 180 for supporting a tension member 184 therebetween along the roof ridge 7. As illustrated in FIG. 9, each roof clamp 180 may include an upright member 182 having top and bottom clamping member, 186 and 188, respectively adapted to engage on the top and bottom surface of a roof at the edges thereof. In particular, the upright may include a bottom arm 183 extending perpendicularly away therefrom at the bottom end of the upright and a shackle 181 or other attachment point proximate to a top end thereof. A slidable arm 185 includes an opening 187 sized to slidably receive the upright 182 therein supports the top clamping member 186 wherein engagement of the top clamping member on the roof causes the opening 187 to frictionally catch on the upright thereby fixing the location of the slidable arm 185 thereon. A distal end of the slidable arm 185 receives a turn screw 189 therethrough which is pivotally connected to the top clamping member 186 with a pivot 190. The top clamping member 186 may be formed of first and second top plates 192 and 194, respectively which are adjustable relative to each other. By way of non-limiting example and as illustrated in FIG. 9, the first and second top plates 192 and 194 may be pivotally connected to each other with a hinge 193 wherein the first plate 192 is connected to the pivot so as to permit the first and second top plates to adjust to match the angle of a roof edge or gable.

The bottom clamping member 188 is formed of first and second bottom plates 195 and 196, respectively which are pivotally connected to each other by a hinge 197. The first and second bottom plates further more include a turnbuckle 198 or other adjustable length member therebetween for adjusting the angle therebetween to correspond to the bottom surface of a roof edge or gable.

The tension member 184 may be selected to have sufficient strength to prevent the fall or injury of a worker as secured thereto as set out below. In particular, the tension member 184 may be selected to be a cable, strap or the like and may include a tensioning means, including by way of non-limiting example, turnbuckle, ratchet or winch. The system may further include a lanyard 200 having a ring or slidable connectors 202 thereon adapted to pass the tension member 184 therethrough. A tether 204 may extend between the central body 104 and the ring 202 so as to pull the carriage 112 was the worker moves away from the carriage along the roof. The distal end of the lanyard 200 may be secured to a worker at a belt 206 harness or other means.

In operation the legs 140 may be adjusted to match the angle of the roof on which the system is to be applied and secured by tightening the fasteners 164. Thereafter the tension member 184 may be passed through the central passage 112 and the roof clamps 180 secured to the edges of the roof with the tension member 184 tight therebetween. A tool carrier 170 may be secured over the carriage and an optional lanyard 200 connected to the tension member. Thereafter, the carriage is permitted to move along the ridge 7 of the roof 6 while being maintained at the ridge by the tension member 184 passing therethrough. It will be appreciated that where a lanyard 200 is also utilized that the movement of the lanyard 200 due to the movement of a worker secured thereto may move the carriage thereby keeping the carriage proximate to the worker.

While specific embodiments have been described and illustrated, such embodiments should be considered illustrative only and not as limiting the disclosure as construed in accordance with the accompanying claims.

What is claimed is:

1. A system for supporting at least one article on a roof comprising:

an elongate member positioned above and extending above a ridge of a roof; and a carriage retained by and translatable along the elongate member, the carriage comprising:

a central body extending along an axis having a top surface;

a pair of legs extending away from the axis of from the central body; and a passage extending through the central body parallel to the axis, the passage freely receiving and longitudinally containing the elongate member therein so as to retain the carriage at a position along the ridge of the roof at a plurality of positions therealong.

2. The system of claim 1 wherein the passage comprises a bore with the axis extending therethrough.

3. The system of claim 2 wherein the central body comprises a tubular member.

4. The system of claim 1 wherein the pair of legs are rotatable relative to the central body.

5. The system of claim 4 wherein the pair of legs are fixable relative to each other at one of a plurality of angles.

6. The system of claim 5 wherein the pair of legs are pivotable along pivot axes parallel to the axis of the apparatus.

7. The system of claim 1 wherein the central body includes a pair of spaced apart end rings with leg openings therebetween each sized to receive one of the pair of legs therein.

8. The system of claim 7 wherein the pair of legs are supported within the leg openings with a rod extending therethrough.

9. The system of claim 8 wherein the pair of legs includes a pin extending therefrom receivable within an arcuate slot in at least one of the end rings.

10. The system of claim 9 further comprising at least one fastener secured to the pin adapted to clamp the end ring between the fastener and the leg.

11. The system of claim 1 wherein the pair of legs comprises a planar member having at least one wheel thereunder.

12. The system of claim 11 wherein the at least one wheel rotates about an axis parallel to the planar member.

13. The system of claim 12 wherein the at least one wheel comprises a pair of spaced apart wheels.

14. The system of claim 1 further comprising a tool carrying body locatable on a top surface of the central body.

15. The system of claim 14 wherein the tool carrying body is securable to the pair of legs.

16. The system of claim 1 further comprising a pair of spaced apart clamps secureable to opposed ends of a roof ridge, the clamps being operable to suspend the elongate member therebetween along and above a ridge of a roof.

17. The system of claim 1 further comprising a safety lanyard extending from the elongate tensile member to a worker, the safety lanyard securable to and extending from the carriage.

18. A method for supporting at least one article on a roof comprising:

locating an elongate member positioned above and extending above a ridge of a roof; and slidably locating a carriage retained by and translatable along the elongate member, the carriage comprising:

a central body having a pair of legs extending away from an axis of the central body;

the pair of legs adjusted to correspond to the slope of the roof;

the central body having a bore therein parallel to the axis, wherein the elongate member passes through and is contained within the bore.

* * * * *